US009829274B2

(12) United States Patent
Vallo

(10) Patent No.: US 9,829,274 B2
(45) Date of Patent: Nov. 28, 2017

(54) FOREND WITH REMOVABLE CORD FOR FIREARM

(71) Applicant: Matthew John Vallo, Dayton, OH (US)

(72) Inventor: Matthew John Vallo, Dayton, OH (US)

( * ) Notice: Subject to any disclaimer, the term of this patent is extended or adjusted under 35 U.S.C. 154(b) by 0 days.

(21) Appl. No.: 15/066,184

(22) Filed: Mar. 10, 2016

(65) Prior Publication Data

US 2016/0265871 A1 Sep. 15, 2016

Related U.S. Application Data

(60) Provisional application No. 62/130,948, filed on Mar. 10, 2015.

(51) Int. Cl.

| | |
|---|---|
| ***F41C 23/16*** | (2006.01) |
| ***F41C 23/18*** | (2006.01) |
| ***F41C 23/22*** | (2006.01) |

(52) U.S. Cl.

CPC ..... *F41C 23/16* (2013.01); *F41C 23/18* (2013.01); *F41C 23/22* (2013.01)

(58) Field of Classification Search

CPC ..... F41C 23/16; F41A 23/18; F41A 23/08; F41A 23/10; F41A 23/04; F41A 23/06

USPC ..... 42/94, 96

See application file for complete search history.

(56) References Cited

U.S. PATENT DOCUMENTS 4,716,809 A * 1/1988 A'Costa ..... F41A 21/34 42/96

7,454,858 B2 * 11/2008 Griffin ..... F41C 23/16 42/71.01

FOREIGN PATENT DOCUMENTS

EP 108 703 * 5/1984

OTHER PUBLICATIONS

Sanders, Gina, "Wrap Your Butt", webpage at www.paracordforum.com/Wrap-Your-Butt.html, posted Dec. 18, 2013, retrieved Mar. 7, 2017.

* cited by examiner

*Primary Examiner* — Stephen M Johnson

(74) *Attorney, Agent, or Firm* — Porter, Wright, Morris & Arthur, LLP

(57) ABSTRACT

A firearm includes a forend having a forend body attached to the firearm below a barrel, and a cord removably secured to a gripping surface of the forend body. The forend body is provided with at least one groove removably receiving the cord to secure the cord to the forend body. The groove is configured to receive the cord therein such that a portion of the cord extends out of the groove so that the slip resistance of the gripping surface of the forend body is improved. The cord can be easily removed from the groove of the forend body whenever the user of the firearm desires to use the cord in any other suitable manner.

22 Claims, 7 Drawing Sheets

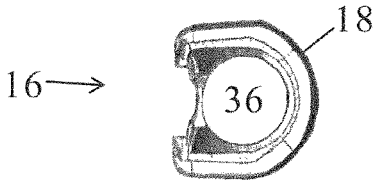
FIG. 13
FIG. 10
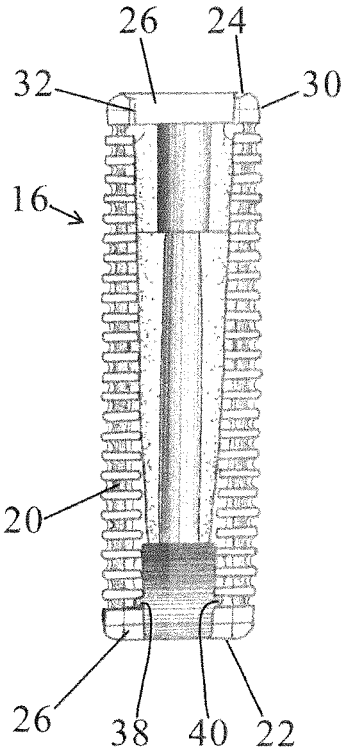
FIG. 11
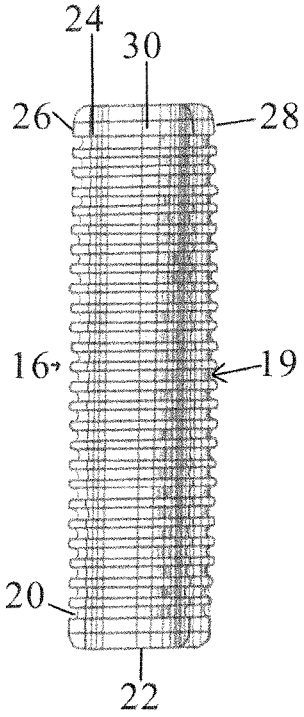
FIG. 12
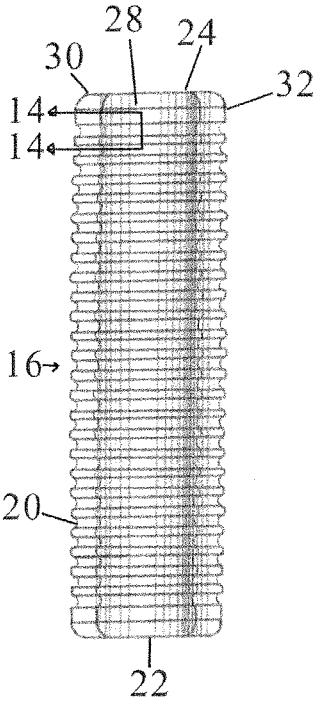
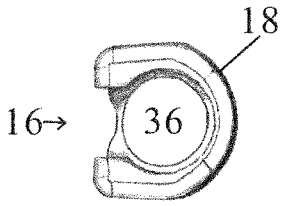
FIG. 9

FOREND WITH REMOVABLE CORD FOR FIREARM

CROSS-REFERENCE TO RELATED APPLICATIONS

This application claims the priority benefit of U.S. Provisional Patent Application No. 62/130,948 filed on Mar. 10, 2015, the disclosure of which is expressly incorporated herein in its entirety by reference.

STATEMENT REGARDING FEDERALLY SPONSORED RESEARCH

Not Applicable

PARTIES TO A JOINT RESEARCH AGREEMENT

Not Applicable

REFERENCE TO APPENDIX

Not Applicable

FIELD OF THE INVENTION

The field of the present invention generally relates to firearms and, more particularly, to a forearm or forend (or fore-end) of a firearm.

BACKGROUND OF THE INVENTION

Long guns such as rifles, shotguns, and the like typically have a one or two piece stock. The stock is typically the portion of the firearm which allows it to be held and/or rested against a shooter's shoulder in order to fire the firearm and to be grasped by the shooters non-firing or forward hand. The stock on a long gun usually provides for comfortable placement of the firing hand and insulating the forward hand from heat of the firearm's barrel upon firing. A rearward portion of the stock that is located rearward of the firearm's action and which is typically rested against the shooter's shoulder when the firearm is in the firing position is typically referred to as a butt stock. A portion directly behind the action which is usually gripped by the shooter's firing hand when the firearm is in the firing position is typically referred to as a wrist. A forward portion of the stock that is located forward of the action and below the barrel and which is typically gripped by a shooter's non-firing hand when the firearm is in the firing position, is typically referred to as a forearm or forend (or fore-end). While the term "stock" is most often used in reference to rifles, shotguns and the like, many handguns and other types of firearms can have grips that can be referred to as stocks.

When used in adverse conditions such as, for example, rain, sleet, and the like, firearms can become slippery and difficult to control. Such a situation is clearly unsafe. Firearm users have developed various home grown methods to reduce or eliminate these slippery conditions. For example, various components of firearms have been wrapped with cloth, cording, etc. to improve the user's grip on the firearm in slippery conditions. These end user modifications can be cumbersome and/or unsafe.

Accordingly, there is a need in the art for improved firearm forends that have improved gripability in adverse conditions.

SUMMARY OF THE INVENTION

Disclosed are firearm systems and methods that overcome at least one of the disadvantages of the prior art described above. For example, disclosed is a forend for securing a cord to a firearm. The forend comprises a forend body configured for attachment to the firearm. The forend body has at least one groove for removably receiving the cord to secure the cord to the forend body.

Also disclosed is a forend assembly for a firearm. The forend assembly comprises, in combination, a forend having forend body configured for attachment to the firearm, and a cord removably secured to the forend body. The forend body has at least one groove removably receiving the cord to secure the cord to the forend body.

Also disclosed is a firearm comprising, in combination, a barrel, a forend having a forend body located below the body, and a cord removably secured to the forend body at a gripping surface of the forend body. The forend body has at least one groove removably receiving the cord to secure the cord to the forend body.

From the foregoing disclosure and the following more detailed description of various preferred embodiments it will be apparent to those skilled in the art that the present invention provides a significant advance in the technology and art of firearms forends. Particularly significant in this regard is the potential the invention affords for providing a forend of a firearm that provides improved grip in adverse conditions and quick access to a cord when needed. Additional features and advantages of various preferred embodiments will be better understood in view of the detailed description provided below.

BRIEF DESCRIPTION OF THE DRAWINGS

These and further features of the present invention will be apparent with reference to the following description and drawing, wherein:

FIG. 9 is a front elevational view of the forend of FIGS. 5 to 8.

FIG. 10 is a top plan view of the forend of FIGS. 5 to 9.

FIG. 11 is a left-side elevational view of the forend of FIGS. 5 to 10.

FIG. 12 is a bottom plan view of the forend of FIGS. 5 to 11.

FIG. 13 is a rear elevational view of the forend of FIGS. 5 to 12.

Figure 1:
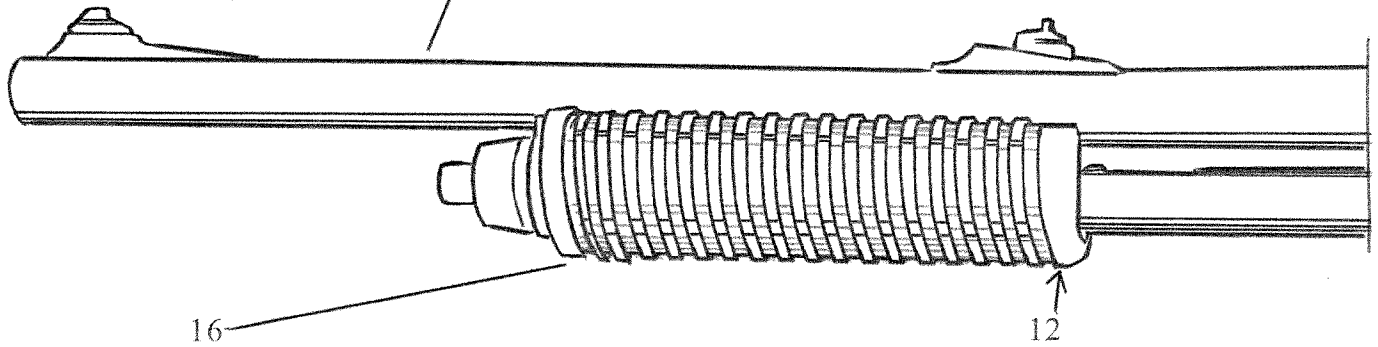
FIG. 1 is a left-side elevational view of a front portion of a firearm having a forend according to the present invention located below a barrel, wherein a cord is removed from the forend.
Figure 2:
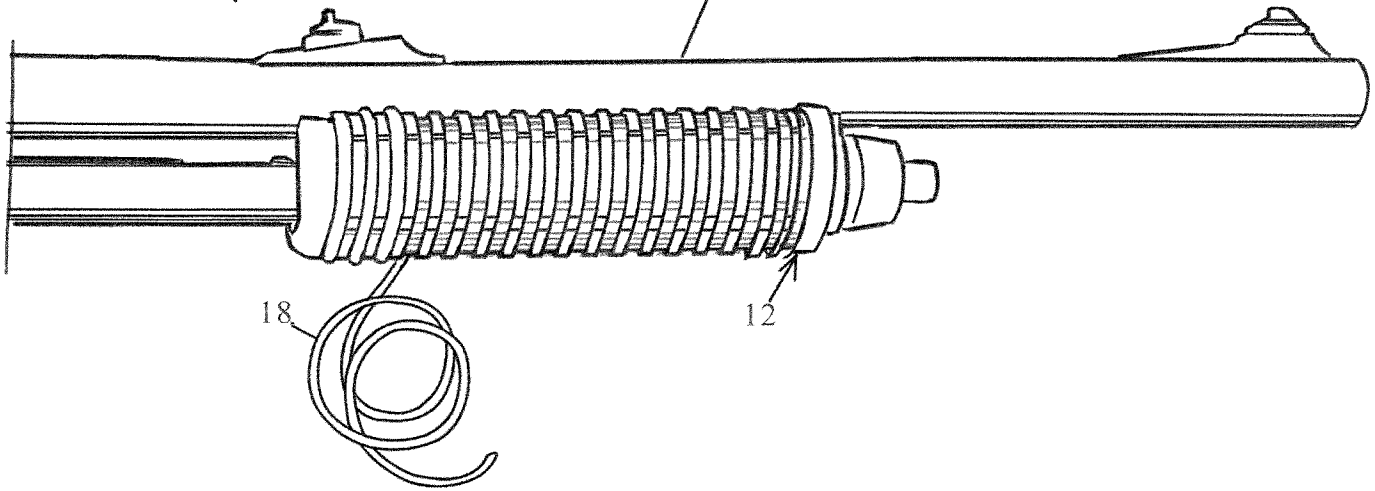
FIG. 2 is a right-side elevational view of the front portion of the firearm of FIG. 1, wherein the cord is partially installed onto the forend.
Figure 3:
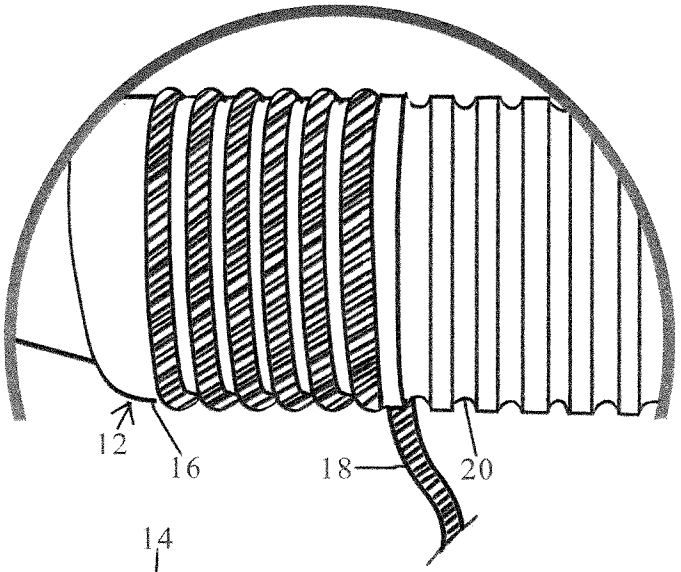
FIG. 3 is an enlarged fragmented view of the cord and forend taken at line 3 of FIG. 2.
Figure 4:
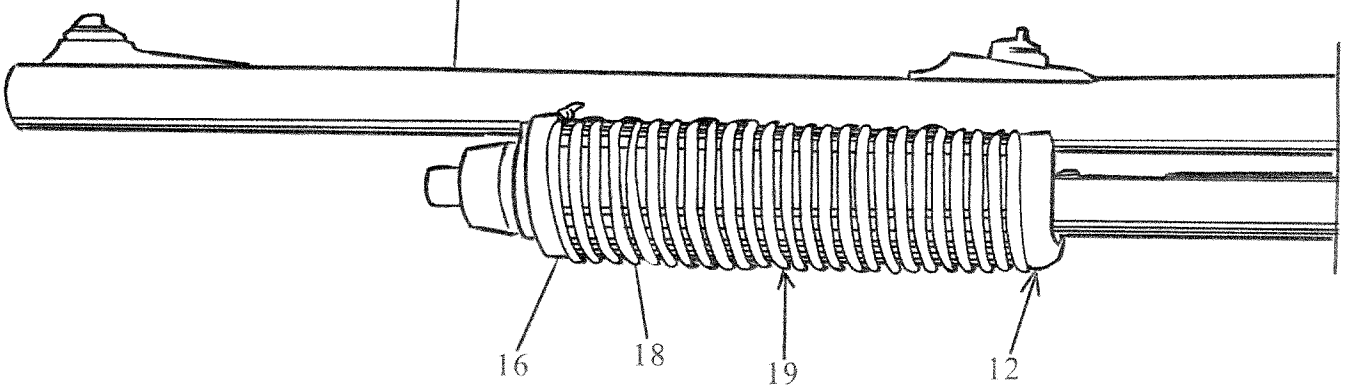
FIG. 4 is a left-side elevational view of the front portion of the firearm of FIG. 1, wherein the cord is fully installed onto the forend.
Figure 5:
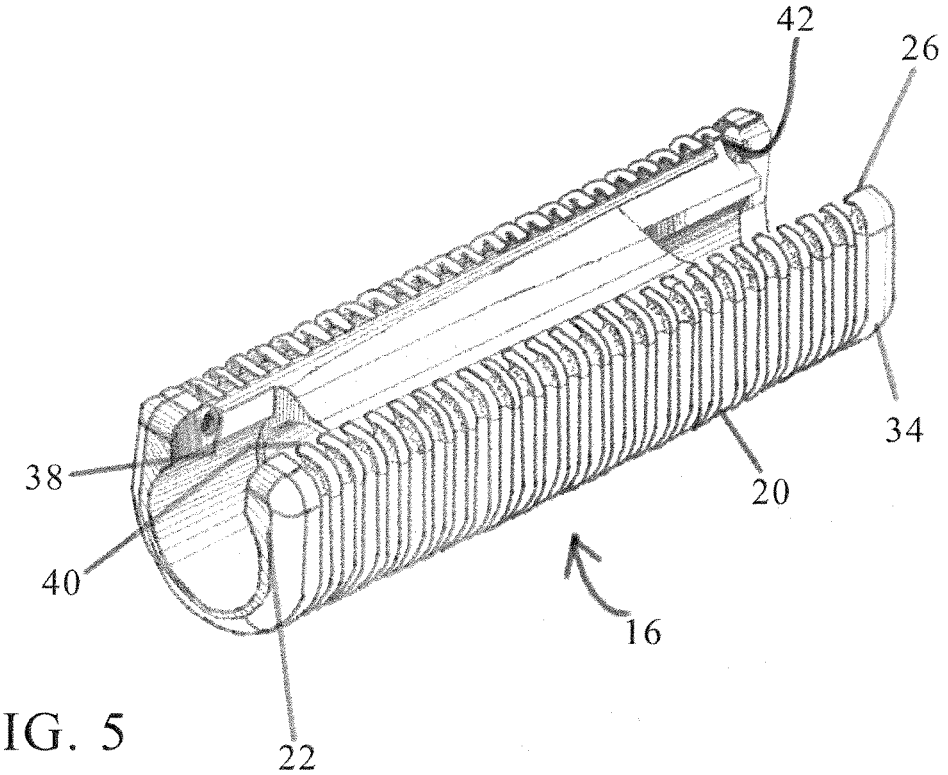
FIG. 5 is a front/top/left-side perspective view of the forend of FIGS. 1 to 4, wherein the cord is removed.
Figure 6:
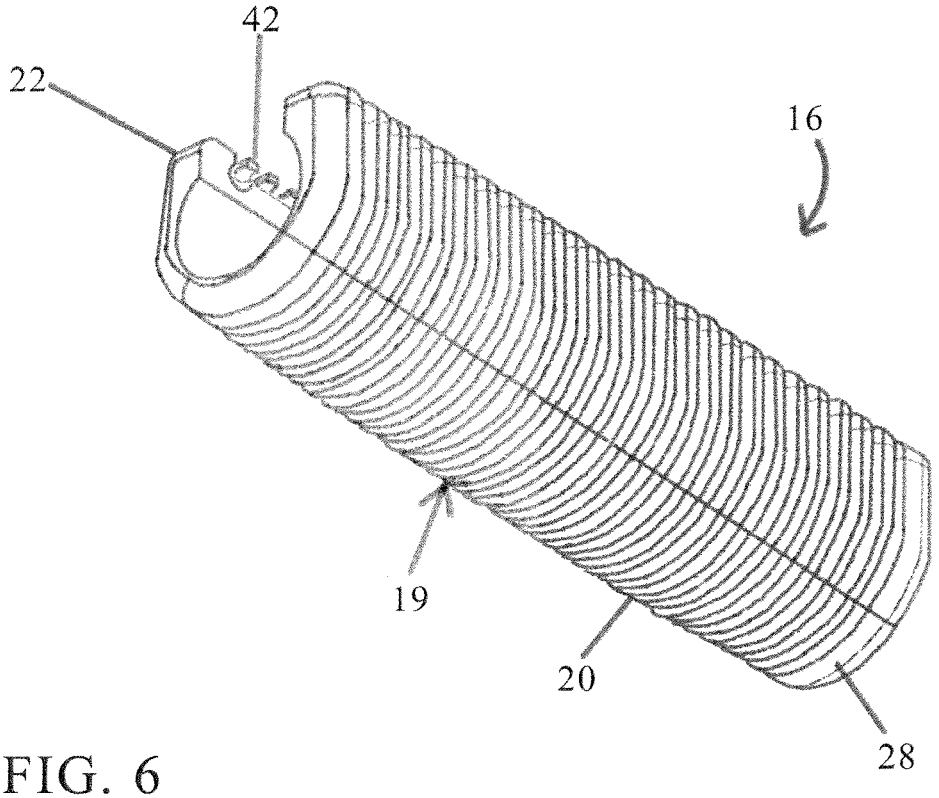
FIG. 6 is a front/bottom/left-side perspective view of the forend of FIG. 5.
Figure 7:
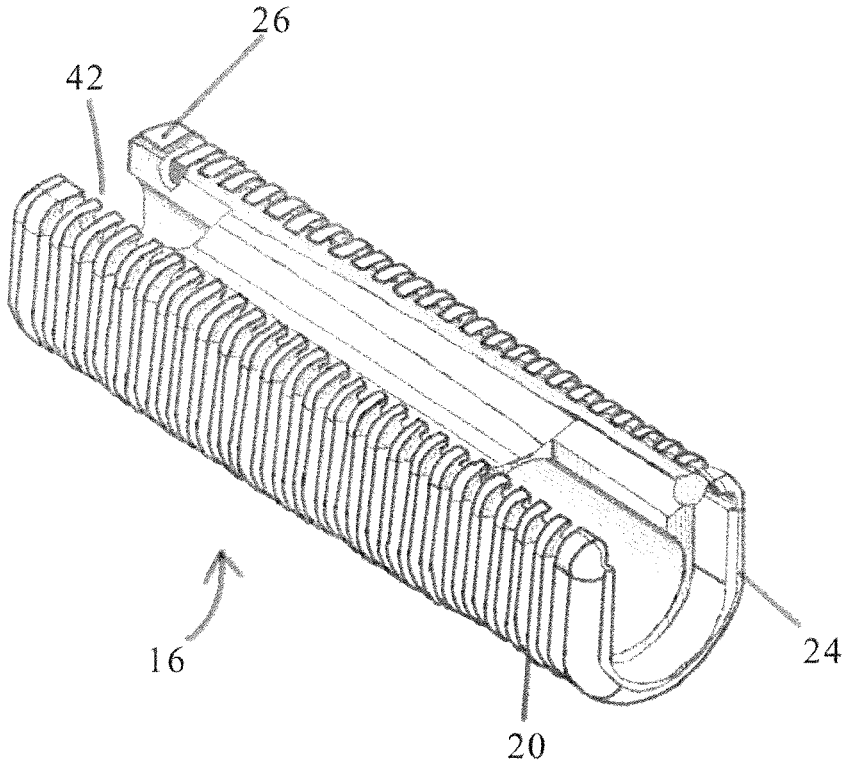
FIG. 7 is a rear/top/left-side perspective view of the forend of FIGS. 5 and 6.
Figure 8:
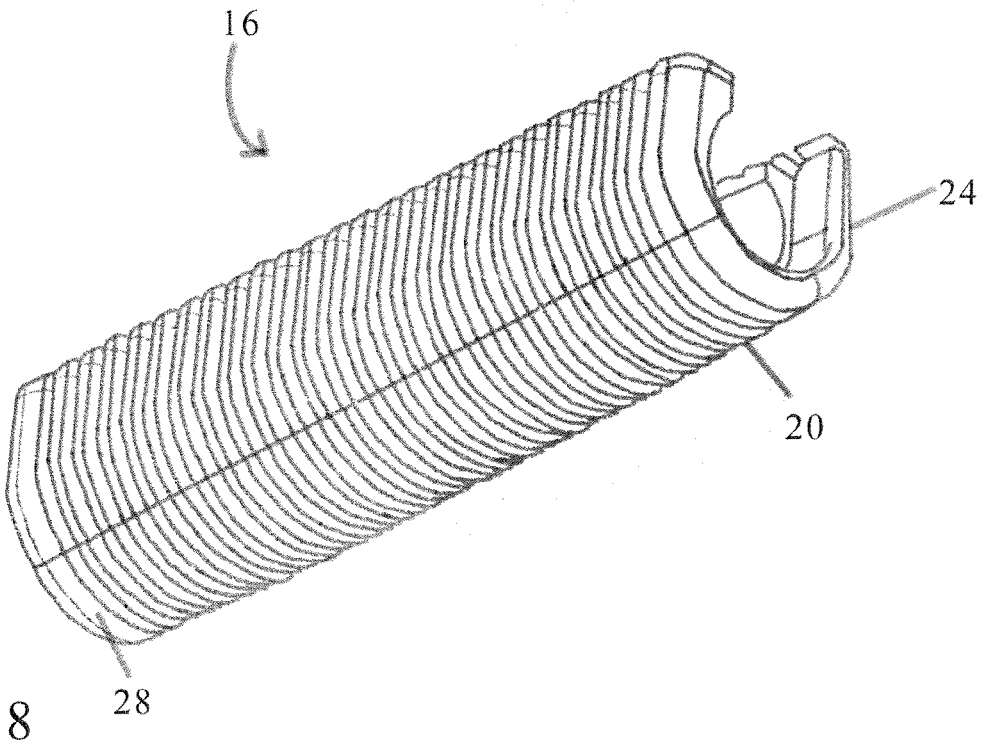
FIG. 8 is a rear/bottom/left-side perspective view of the forend of FIGS. 5 to 7.

It should be understood that the appended drawings are not necessarily to scale, presenting a somewhat simplified representation of various preferred features illustrative of the basic principles of the invention. The specific design features of the firearms as disclosed herein, including, for example, specific dimensions and shapes of the various components will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the firearms and/or forends illustrated in the drawings. In general, up or upward refers to an upward direction generally within the plane of the paper in FIG. 1 and down or downward refers to a downward direction generally within the plane of the paper in FIG. 1. Also in general, forward or front refers to a direction extending to the left within the plane of the paper in FIG. 1 and back or rear refers to a direction extending to the right within the plane of the paper in FIG. 1.

DETAILED DESCRIPTION OF CERTAIN PREFERRED EMBODIMENTS

It will be apparent to those skilled in the art, that is, to those who have knowledge or experience in this area of technology, that many uses and design variations are possible for the firearm systems and methods disclosed herein. The following detailed discussion of various alternative and preferred embodiments will illustrate the general principles of the invention with regard to the specific application of a long gun having a two part stock with a forend. Other embodiments suitable for other applications such as, for example, long guns having one-piece stocks, hand guns, and other types of firearms, will be apparent to those skilled in the art given the benefit of this disclosure.

FIGS. 1 to 4 illustrate a firearm 10 having a forend 12 according to a first embodiment of the present invention. The illustrated firearm 10 comprises a barrel 14, and the forend 12 located below the barrel 14. The illustrated forend 12 has a forend body 16 secured to the firearm 10, and a cord 18 removably secured to a grip or gripping surface 19 of the forend body 16. The illustrated forend body 16 has at least one groove 20 open only at its outer side and removably receiving the cord 18 to removably secure the cord 18 to the forend body 16. The term "forend" is used herein and in the claims to mean a firearm component or portion forming a gripping surface for a forward or non-firing hand of the firearm user.

As best shown in FIGS. 5 to 13, the illustrated forend body 16 has a generally-planar front end 22, a generally-planar rear end 24 opposite the front end 22, a generally-planar top side 26 extending between the front and rear ends 22, 24, an arcuate bottom side 28 opposite the top side 26 and extending between the front and rear ends 22, 24, a generally-planar left side 30 connecting the top and bottom sides 26, 28 and extending between the front and rear ends 22, 24, and a generally-planar right side 32 opposite the left side 30 and connecting the top and bottom sides 26, 28 and extending between the front and rear ends 22, 24. The illustrated bottom side 28 is arcuate or rounded so that an outer or exterior surface 34 of the forend body is generally U-shaped in cross section perpendicular to the longitudinal axis extending between the front and rear ends 22, 24. Configured in this manner, the illustrated bottom, left, and right sides 28, 30, 32 of the forend body 16 form the grip or gripping surface 19 for the free or forward hand of the user of the firearm 10. The illustrated forend body 16 also has a longitudinally extending passage 36 extending between the front and rear ends 22, 24 and forming front and rear openings therein respectively. The passage 36 is sized and configured for receiving components of the firearm 10 for attachment of the forend body 16 to the firearm 10 in a known manner. It is noted that the forend body 16 can alternatively have any other suitable configuration.

The illustrated forend body 16 has a plurality of the grooves 20 with each of the separate grooves 20 having a first end 38 and a second end 40. The illustrated grooves 20 are generally parallel and spaced-apart from one another between the front and rear ends 22, 24 of the forend body 16. The first and second ends 38, 40 of each of the illustrated grooves 20 are located at the top side 26 of the forend body 16 and are facing each other with the groove 20 extending about the left side 30, the bottom side 28, and the right side 32 of the forend body 16. Thus, the first and second ends 38, 40 of each groove 20 are laterally spaced-apart and face each other and the groove 20 encircles the forend body 16 about its longitudinal axis except for the space between the first and second ends 38, 40 at the top side 26 of the forend body 16. The illustrated first and second ends 38, 40 of each of the grooves 20 are each open to form tabs or detents 42 between adjacent open ends 38, 40 of the grooves 20 so that the cord 18 can wrap around the tabs 42 between the adjacent grooves 20 to change the direction of the cord 18 about 180 degrees as described in more detail hereinafter. Thus the illustrated grooves 20 collectively form a serpentine path or groove for the cord 20 that winds back and forth below the forend body 16 and having a length for receiving substantially the entire length of the cord 18. It is noted that the groove or grooves 20 can alternatively have any other suitable configuration.

Figure 14:
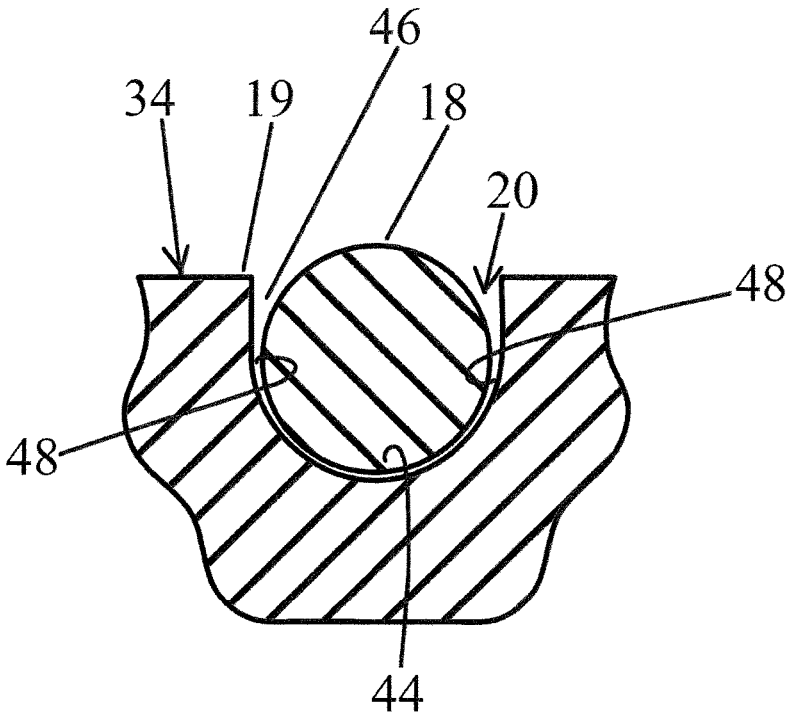
FIG. 14 is cross sectional view taken along line 14-14 of FIG. 12, wherein the cord has been added.

As best shown in FIG. 14, the illustrated groove or grooves 20 are configured to receive the cord 18 therein such that a portion of the exterior diameter or surface of the cord 18 extends outside of the grooves 20. In cross section, each of the illustrated grooves has a closed inner end 44, an open outer end 46 opposite the inner end 44, and generally straight opposed sides 48 extending between the inner end 44 and the outer end 46 so that the groove 20 is generally U-shaped in cross section. The width of each groove 20 can be sized to provide a close fit, a friction fit, or any other suitable fit for the cord 18. The illustrated depth of the groove 20 is sized so that the cord 18 partially extends out of the open end of the groove 20 so that the cord 18 provides protrusions extending from the exterior surface 34 of the forend body 16 at the gripping surface 19 to improve the slip resistance of the exterior surface 34 of the forend body 16 at the gripping surface 19. That is, the gripping surface 19 with the cord 18 has a greater slip resistance than at other portions of the exterior surface 34 of the forend body 16 not having the cord 18. It is noted that the groove or grooves 20 can alternatively have any other suitable cross-sectional shape.

The forend body 16 can comprise any suitable material such a, for example, wood, a plastic, metal, a combination thereof, and the like.

The illustrated cord 18 is a predetermine length of parachute cord also referred to as para cord 550 or 550 cord when referring to type-III para cord. Para cord 550 is a lightweight nylon kernmantle rope originally used in the suspension lines of parachutes. However, this type of cord is useful for many other tasks and is now used as a general purpose utility cord by both military personnel and civilians. Kernmantle rope is rope constructed with an interior core or kern protected by a woven exterior sheath or mantle designed to optimize strength, durability, and flexibility. The fibers of the core provide tensile strength for the rope, while the sheath protects the core from abrasion during use. The sheath is typically braided having a high number of interwoven strands for its size, giving the sheath a relatively smooth texture. An all-nylon construction makes para cord 550 resiliently elastic. Current technical standards for the manufacture of para cord 550 for use in parachutes are published by the Parachute Industry Association. The US military MIL-C-5040H standard requires parachute cord material to be nylon but similar styles of para cord 550 are manufactured with other materials such as, for example, polyester. The length of the length of the cord is substantially the same as the collective length of the grooves. The illustrated cord 18 additionally has suitable length suitable to form overhand knots 50 at each free end of the cord 18 outside the grooves 10. The cord 18 can also have any suitable color such as, for example, camouflage green, safety orange, and the like. It is noted that the cord 18 can alternatively be of any other suitable type and/or of any other suitable configuration.

Figure 15:
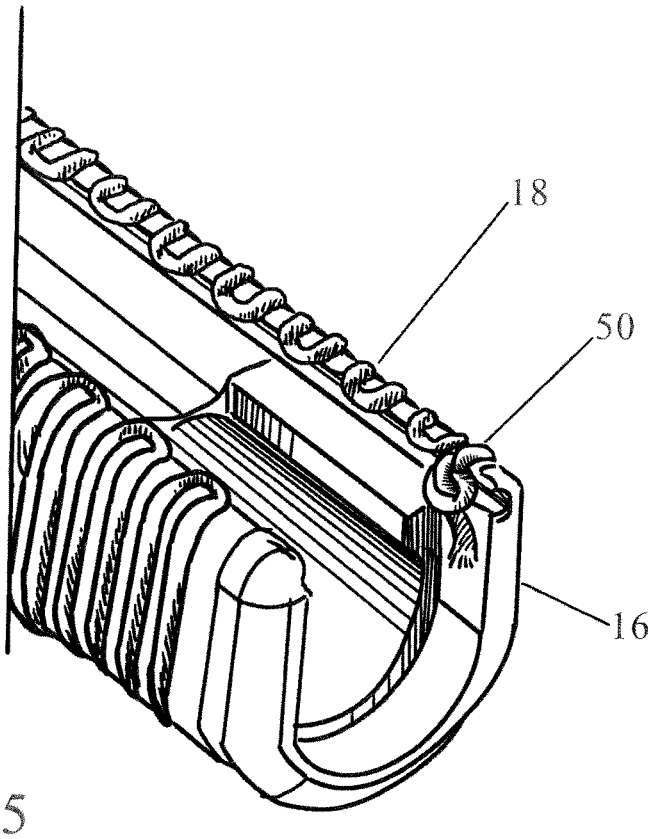
FIG. 15 is an enlarged and fragmented rear/left/top perspective view showing a rear portion of the forend of FIGS. 5 to 14, wherein the cord is fully installed on the forend.
Figure 16:
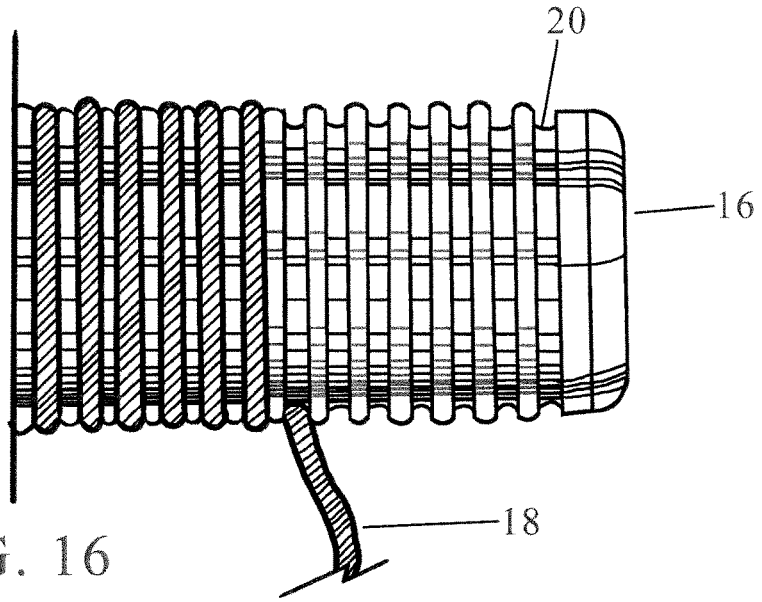
FIG. 16 is an enlarged and fragmented left-side elevational view showing a rear portion of the forend of FIGS. 5 to 14, wherein the cord is partially installed on the forend.

As best shown in FIGS. 15 and 16, the illustrated cord 18 is removably secured to the forend body 16 within the groove 20 while the forend body 16 is attached or unattached to the firearm 10. A first end of the cord 18 is inserted into one of the ends 38, 40 of the first groove 20 adjacent either the front end 22 or the rear end 24 of the forend body 16. The cord 18 is then progressively placed within the groove 20 so that the cord 18 wraps around the forend body 16 until it reaches the t other end 44, 46 of the groove 20. The cord 18 is then turned about 180 degrees so that it wraps around the tab 42 and is extended into the end 44, 46 of the adjacent groove 20. The cord 18 is then e progressively placed within the adjacent groove 20 so that the cord 18 wraps around the forend body 16 until it reaches the other end 4, 46 of the adjacent groove 20. This method is repeated until the cord 18 is within all of the grooves 20 and is removably secured to the forend body 16 in a serpentine manner at the gripping surface 19. It is noted that the cord 18 can be secured within the groove or grooves via the overhand knots 50 (having a width greater than the width of the open ends 46, 48 of the grooves 20) located at one or both free ends of the cord 18, tension placed within the cord 18 by stretching the cord 18 during installation of the cord 18, a friction fit between the cord 18 and the groove or grooves 20, or a combination thereof. The cord 18 can be removed from the groove or grooves 20 in a reverse manner when desired and reinstalled within the groove or grooves 20 in the same manner when desired. It is noted that the cord 18 can be installed, removed, and/or reinstalled as many times as desired.

Any of the features or attributes of the above-described embodiments and variations can be used in combination with any of the other features and attributes of the above-described embodiments and variations as desired.

From the foregoing disclosure it will be apparent that the illustrated forend provides greatly improved gripping ability. Also from the foregoing disclosure it is apparent that the illustrated forend includes an easy to remove cord that is available for use when desired by the firearm user. It should be further appreciated from the above disclosure that a forend body alone can be marketed wherein the cord can be separately obtained, a forend assembly including both the forend body and the cord can be marketed, and a firearm having an integral forend assembly including both the forend body and the cord can be marketed.

From the foregoing disclosure and detailed description of certain preferred embodiments, it will be apparent that various modifications, additions and other alternative embodiments are possible without departing from the true scope and spirit of the present invention. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A forend handhold for securing a cord to a firearm having a barrel, the forend handhold comprising, in combination:

a forend body having a gripping surface and configured for attachment to the firearm below the barrel; and wherein the forend body has at least one groove in the gripping surface forming a serpentine path for removably receiving the cord to removably secure the cord to the forend body in a serpentine manner.

2. The forend handhold according to claim 1, wherein, the at least one groove is configured with a depth sized to receive the cord therein such that a portion of the cord extends out of the groove.

3. The forend handhold according to claim 1, wherein the forend body has a front end and a rear end, and there is a plurality of the grooves with each of the grooves having a first end and a second end, and the grooves are generally parallel and spaced-apart from one another between the front and rear ends of the forend body.

4. The forend handhold according to claim 3, wherein the first and second ends of the grooves are each open and the cord is wrapped around and between the ends of adjacent ones of the grooves.

5. The forend handhold according to claim 3, wherein the forend body has a top, a bottom opposed to the top, a left side connecting the top and the bottom, and a right side opposed to the left side and connecting the top and the bottom, and wherein the first and second ends of each of said grooves are located at the top of the forend body with the groove extending between the first and second ends about the left side, the bottom, and the right side of the forend body.

6. The forend handhold according to claim 3, wherein the first and second ends of each of said grooves are spaced apart and face each other.

7. The forend handhold according to claim 3, wherein tabs are formed between adjacent ones of the grooves at the first and second ends of the grooves and the cord is wrapped around the tabs at adjacent ones of the grooves.

8. A forend handhold assembly for a firearm having a barrel, the forend handhold assembly comprising, in combination:

a forend handhold having a gripping surface and configured for attachment to the firearm below the barrel;

a cord removably secured to the forend handhold; and wherein the forend handhold has at least one groove in the gripping surface forming a serpentine path removably receiving the cord to removably secure the cord to the forend handhold in a serpentine manner.

9. The forend handhold assembly according to claim 8, wherein, the at least one groove is configured with a depth sized to receive the cord therein such that a portion of the cord extends out of the groove.

10. The forend handhold assembly according to claim 8, wherein the forend handhold has a front end and a rear end, and there is a plurality of the grooves with each of the grooves having a first end and a second end, and the grooves are generally parallel and spaced-apart from one another between the front and rear ends of the forend handhold.

11. The forend handhold assembly according to claim 10, wherein the first and second ends of the grooves are each open and the cord is wrapped around and between the ends of adjacent ones of the grooves.

12. The forend handhold assembly according to claim 10, wherein the forend handhold has a top, a bottom opposed to the top, a left side connecting the top and the bottom, and a right side opposed to the left side and connecting the top and the bottom, and wherein the first and second ends of each of said grooves are located at the top of the forend handhold with the groove extending between the first and second ends about the left side, the bottom, and the right side of the forend handhold.

13. The forend handhold assembly according to claim 10, wherein the first and second ends of each of said grooves are spaced apart and face each other.

14. The forend handhold assembly according to claim 10, wherein tabs are formed between adjacent ones of the grooves at the first and second ends of the grooves and the cord is wrapped around the tabs at adjacent ones of the grooves.

15. A firearm comprising, in combination:

a barrel;

a forend handhold having a gripping surface and located below the barrel;

a cord removably secured to the gripping surface of the forend handhold; and wherein the forend handhold has at least one groove in the gripping surface forming a serpentine path removably receiving the cord to removably secure the cord to the forend handhold in a serpentine manner.

16. The firearm according to claim 15, wherein, the at least one groove is configured with a depth sized to receive the cord therein such that a portion of the cord extends out of the groove.

17. The firearm according to claim 15, wherein the forend handhold has a front end and a rear end, and there are a plurality of the grooves with each of the grooves having a first end and a second end, and the grooves are generally parallel and spaced-apart from one another between the front and rear ends of the forend handhold.

18. The firearm according to claim 17, wherein the first and second ends of the grooves are each open and the cord is wrapped around and between the ends of adjacent ones of the grooves.

19. The firearm according to claim 17, wherein the forend handhold has a top, a bottom opposed to the top, a left side connecting the top and the bottom, and a right side opposed to the left side and connecting the top and the bottom, and wherein the first and second ends of each of said grooves are located at the top of the forend handhold with the groove extending between the first and second ends about the left side, the bottom, and the right side of the forend handhold.

20. The firearm according to claim 17, wherein the first and second ends of each of said grooves are spaced apart and face each other.

21. The forend handhold assembly according to claim 8, wherein the cord is para cord.

22. The firearm according to claim 15, wherein the cord is para cord.

* * * * *